US008734877B2

(12) United States Patent
Hömme et al.

(10) Patent No.: US 8,734,877 B2
(45) Date of Patent: May 27, 2014

(54) METHOD FOR ADJUSTING AN OPERATING PROGRAM BY MEANS OF VISUALIZED PARAMETERS RELATING TO THE PRODUCT TO BE COOKED, AND A COOKING APPLIANCE THEREFOR

(75) Inventors: Regina Hömme, Augsburg (DE); Michael Greiner, Landsberg (DE); Judith Kling, Landsberg (DE)

(73) Assignee: Rational AG (DE)

( * ) Notice: Subject to any disclaimer, the term of this patent is extended or adjusted under 35 U.S.C. 154(b) by 529 days.

(21) Appl. No.: 12/713,838

(22) Filed: Feb. 26, 2010

(65) Prior Publication Data

US 2010/0199854 A1 Aug. 12, 2010

Related U.S. Application Data

(63) Continuation of application No. PCT/DE2008/001390, filed on Aug. 22, 2008.

(51) Int. Cl.
*A23L 1/01* (2006.01)
*G01N 33/02* (2006.01)

(52) U.S. Cl.
USPC ..... 426/233; 426/523

(58) Field of Classification Search
USPC ..... 99/325, 331, 337, 468, 476; 219/506, 219/720, 494, 492, 501, 414, 393; 426/233, 426/523
See application file for complete search history.

(56) References Cited

U.S. PATENT DOCUMENTS

| | | | | |
|---|---|---|---|---|
| 4,933,527 | A * | 6/1990 | Edamura | 219/714 |
| 6,097,016 | A * | 8/2000 | Hirata et al. | 219/720 |
| 7,057,142 | B1 * | 6/2006 | Lubrina | 219/506 |
| 7,141,258 | B2 | 11/2006 | Hillmann | |
| 2006/0289459 | A1 | 12/2006 | Schmidt et al. | |
| 2008/0295702 | A1 | 12/2008 | Wiedemann et al. | |
| 2010/0050119 | A1 * | 2/2010 | Breunig et al. | 715/812 |

FOREIGN PATENT DOCUMENTS

| | | | |
|---|---|---|---|
| DE | 3701308 | A1 | 7/1988 |
| DE | 10336115 | A1 | 3/2005 |
| DE | 102004046521 | B3 | 4/2006 |
| DE | 102004013553 | B4 | 11/2006 |
| DE | 102007040651 | A1 | 3/2009 |
| EP | 1338849 | A1 | 8/2003 |
| EP | 1384951 | A1 | 1/2004 |
| EP | 1741989 | A2 | 1/2007 |
| EP | 1716795 | A1 | 5/2007 |
| EP | 1953457 | A1 | 8/2008 |
| JP | 2122119 | | 5/1990 |
| WO | WO03/001190 | A1 | 2/2003 |

OTHER PUBLICATIONS

Wittmann-Regis, Agnes, Mar. 2, 2010 International Preliminary Report on Patentability from corresponding PCT Application No. PCT/DE2008/001390 (6 pp.).

* cited by examiner

*Primary Examiner* — Reginald L Alexander
(74) *Attorney, Agent, or Firm* — Jones Day

(57) ABSTRACT

A method relates to adjusting a parameter of a process to be executed in a cooking appliance. The parameter has a range of values. The method includes displaying a set of pictorial depictions on a display. Each pictorial depiction represents one of the values in the range. A manual selection from among the pictorial depictions is input. The process is executed in accordance with the value represented by the manually selected pictorial depiction.

18 Claims, 2 Drawing Sheets

METHOD FOR ADJUSTING AN OPERATING PROGRAM BY MEANS OF VISUALIZED PARAMETERS RELATING TO THE PRODUCT TO BE COOKED, AND A COOKING APPLIANCE THEREFOR

CROSS-REFERENCE TO RELATED APPLICATION

This application is a continuation of International Application No. PCT/DE2008/001390, filed Aug. 22, 2008, which claims priority to German Patent Application No. 102007040651.9, filed Aug. 27, 2007, and both applications are hereby incorporated herein by reference.

TECHNICAL FIELD

This relates to a method for adjusting an operating program that is to be executed in an interior of a cooking appliance and includes at least one cooking program and/or at least one cleaning program.

BACKGROUND

The applicant has used a method for the cooking appliance sold on the market under the trade name SelfCooking Center®, in which a display and control device is used in the form of a touch screen, as shown partially in FIGS. 5-6. According to this method, after selection of a product to be cooked, in this example "universal roast", the selected product to be cooked is displayed on a display 100. It is displayed in the area of a type of display relating to the product to be cooked 101 by means of a text information. For this selected type of product to be cooked, in respective selection areas for an external degree of cooking 102 and an internal degree of cooking 106, the desired degree of cooking can be selected. For this purpose, three selection buttons 103-105 and 107-109, respectively for external and internal degrees of cooking, are available. Their actuation requires basic knowledge of an operator, since the selectable degrees of cooking are described by a text. Operators in or from different countries understand different cooking results when the same text description for a degree of cooking is given. For example, it is well known that "pink" to describe a piece of meat is different in France than it is in Germany. And even within the same country, different regions or cooking styles have different standards. This leads to errors in operation and unsatisfactory cooking results respectively.

FIG. 6 shows a selection area for a size of the product to be cooked 110. Three selection buttons 111-113 are provided which entail the same adjustment difficulties as in the case of the degree of cooking shown in FIG. 5, since each operator will have different notions of what is meant by a "small" or "large" product to be cooked, when dealing for example with a roast.

A display and control device similar to FIG. 5 is also known from DE102004013553 B4. It discloses that a parameter can be pre-adjusted to be country-specific for the respective installation site and/or specific to one selectable operating language of a cooking appliance respectively. It discloses details on a dependence of a parameter relating to the product to be cooked on an installation site and/or operating language.

A method is known from EP1338849 A1, wherein a point can be approached by means of an input device in an at least two-dimensional characteristic field by an operator of the cooking appliance to adjust at least two parameters relating to the product to be cooked, so that the adjusted point can be implemented as part of the cooking process in a cooking program. This enables the degree of browning (external degree of cooking) and the core temperature (internal degree of cooking) of the product to be cooked to be selected as parameters relating to the product to be cooked. This method requires detailed knowledge by the operator of the parameters relating to the product to be cooked. This is particularly so since each parameter relating to the product to be cooked must be selected using specific numeric values. Thus, the operator must be a trained member of staff. Even in cases where the operator is a trained member of staff, the method known from EP1338849 is complicated such that the risk of operating errors and thus of undesired cooking results can be high.

EP1384951 A1 as well as the parallel U.S. Pat. No. 7,057,142 disclose a method in which a degree of browning, as an external degree of cooking, can be selected by means of a touch screen, and an internal degree of cooking can be selected by means of the color inside of the product to be cooked. This is achieved by using bar charts which represent specific numeric values for the adjustable parameters relating to the product to be cooked. Thus, this method provides the same disadvantages as the cooking method of EP1338849.

DE102004046521 B3 discloses a method for adjusting or selecting an operating program of a cooking appliance, in which a pre-adjusted parameter can be changed by, for example, actuating a pictogram button.

EP1716795 A1 discloses the use of selection elements for the product to be cooked which offer visualized products to be cooked, selection elements for the product to be cooked and calibration selection elements for the product to be cooked. A visualization of the products to be cooked is provided by an illustration of the products, for example with a simple illustration of a fish for fish products. This simplifies the selection of a type of product to be cooked. However, the selection elements for the product to be cooked and the calibration selection elements for the product to be cooked provide alpha-numeric symbols which in turn make it difficult for untrained operators to make a selection.

A visualization of a selected product to be cooked, in form of the origin of a piece of meat, such as a shoulder of a pork, is known from EP1741989 A2.

The display of a selected mass and the type of a product to be cooked is known from DE3039301 A1.

A button arrangement with three function fields, respectively for a type of preparation, a type of food and a quantity of food, is known from DE3701308 A1.

DE10336115 A1 discloses a cooking appliance with a browning sensor device, an electronic unit, a storage unit and an input unit. A degree of browning can be retrieved, stored and modified by means of a free selectable name. Furthermore, a residual cooking time can be calculated by comparing a sensed degree of browning and a predetermined degree of browning. The sensed degree of browning can be displayed during operation of the cooking appliance on a display field. The browning must be selected by a name, and thus specialized knowledge is required.

JP02-122119 A discloses a cooking appliance. The appliance includes a camera that records an image of a product to be cooked. The appliance further includes a cooking progress decision device that compares the image with a plurality of pre-adjusted images. An operator can select other images by means of a keypad to select a desired cooking result. The cooking procedure is not started before desired cooking result has been selected. This selection method provides only a low degree of flexibility, since the desired end result is not possible by individual selection of parameters relating to the product to be cooked, and it is subject to error, in particular by untrained operators, due to the necessity of making inputs via the keypad.

For a toaster, it is known from WO 03/011090 A1 that a desired browning of a piece of toast can be adjusted by moving an indicator along a browning scale. It is also known from WO 03/011090 A1 that the color of a piece of toast can be recorded during a toasting procedure and compared with the desired end color, to determine the end time of the toasting procedure. The color scale provided for an operator does not correspond to the actual color of the piece of toast desired, but comprises grey tones from white to black. This, in turn, complicates the selection of a desired degree of browning. Also, a toaster cannot be compared to a cooking appliance, in whose cooking chamber a plurality of different products to be cooked can be cooked selectively, by, for example, applying hot air and/or steam.

Furthermore, cleaning methods for cooking appliances are known from the prior art wherein a degree of cleaning is determined, for example, by a degree of soiling, degree of calcification and/or degree of corrosion. EP1953457 relates to such a cleaning method and discloses the calculation of a degree of soiling by calculating a soiling account by sum up soiling points over time.

SUMMARY

Figure 1:
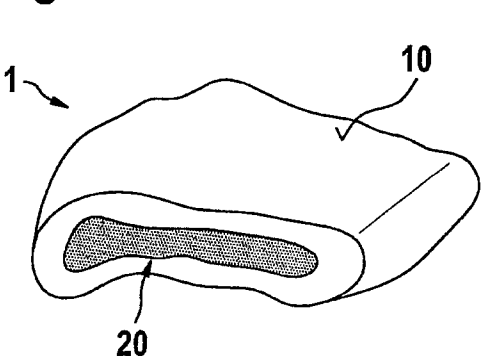
FIG. 1 shows a visualized representation of a type of product to be cooked on a display and control device.

A system and method are provided for adjusting a parameter of a process to be executed in a cooking appliance. The parameter has a range of values. For example, a method includes displaying a set of pictorial depictions on a display. Each pictorial depiction represents one of the values in the range. A selection from among the pictorial depictions is input. The process is executed in accordance with the value represented by the manually selected pictorial depiction.

The parameter can relate to degree of cooking to which a food should be cooked in the appliance. The pictorial depictions can differ in color to represent the differing values of degree of cooking. They can be realistic depictions of the color of the food for respective degrees of cooking. The degree of cooking can relate to degree of external and/or internal cooking. The parameter can relate to size of the food to be cooked in the appliance, degree of thawing of the food to be cooked, or condition of the food.

The method can further include inputting a selection of a type of food to be cooked in the appliance. The appearance of the set of displayed pictorial depiction can be based on the type of food selected. The number of pictorial depictions displayed can be based on the type of food selected. The inputting of the selection of the type of food can include first inputting a selected type of animal, then displaying pictorial depictions of parts of the selected animal, and then inputting a selection from among the pictorial depictions of the parts of the animal.

The process to be executed by the appliance can be cleaning of the appliance. The parameter can relate to a degree of matter to be cleaned from the appliance, or to the amount and/or type of cleaning agent used in the cleaning, or to the degree of cleanliness to which the appliance should be cleaned.

The appliance performing the process can be an oven in a restaurant, and the inputting of the selection can entail inputting, directly from a customer visiting the restaurant, the customer's selection.

DETAILED DESCRIPTION

A cooking program, which runs in a cooking chamber of the cooking appliance, is selected as an operating program. A product to be cooked is selected from a plurality of products to be cooked. At least one parameter relating to the product to be cooked is selected as a first parameter from a plurality of parameters relating to the product to be cooked. A first parameter relating to the product to be cooked is a degree of cooking, such as an internal degree of cooking and/or an external degree of cooking. A second parameter relates to a size of the product to be cooked, such as a thickness of the product to be cooked, a height of the product to be cooked, a weight of the product to be cooked and/or a caliber of the product to be cooked. These might relate to the size at the beginning of the cooking procedure and/or at the end of a cooking procedure. A third parameter is a degree of thawing of the product to be cooked. A fourth parameter is related to the condition of the product to be cooked, based on whether the product to be cooked is fresh, pre-cooked and/or deep-frozen when placed in the cooking chamber, can be adjusted.

A selection of a product to be cooked includes the selection of a type of product to be cooked. When a type of animal is selected as a type of product to be cooked, a part of the animal can be selected from a plurality of visualized parts, wherein the selected part is displayed in an enlarged form.

After selecting a type of product to be cooked from a plurality of visualized types of product to be cooked, such as after selecting a part from a plurality of visualized parts, this selected type of product to be cooked, in particular this selected part, is displayed at least partially in a visualized manner in a cross-section view. A first area of the visualized, selected type of product to be cooked (in particular of the part, which represents the interior of the product to be cooked, in particular the part, and thus the internal degree of cooking) can be activated in order to adjust a first parameter relating to the product to be cooked from a plurality of internal degrees of cooking which are visualized in color. A second area of the visualized, selected type of product to be cooked represents the outside of the product to be cooked, and thus the external degree of cooking can be activated in order to adjust another first parameter relating to the product to be cooked from a plurality of external degrees of cooking which are visualized in color.

The visualization of a plurality of internal degrees of cooking for adjusting the first parameter relating to the product to be cooked can occur by means of the display of a plurality of full cooking adjustment areas. This can be determined by the form and/or size and color of the first area in the interior of the partially visually displayed and selected type of product to be cooked. The number and/or display of full cooking adjustment areas can be determined depending on the selected type of product to be cooked, the selected part, the installation site of the cooking appliance and/or the operating language of the cooking appliance.

The visualization of external degrees of cooking for adjusting the other first parameter relating to the product to be cooked occurs by means of the display of a plurality of browning adjustment areas on a browning scale. The number and/or colors of the browning adjustment areas can be determined based on the selected type of product to be cooked, the selected part, the installation site of the cooking appliance and/or the operating language of the cooking appliance.

In one example, roasting is selected by an operator in a cooking appliance. First, "roast" is selected by the operator from a plurality of possible types of product to be cooked. This can be done by touching a button on which a roast is displayed in a visualized manner. Thus, as shown in FIG. 1, the roast 1 is selected as the product to be cooked and can be seen on a display and control device, along with its surface of the product to be cooked 10 and its interior of the product to be cooked 20.

Figure 2:
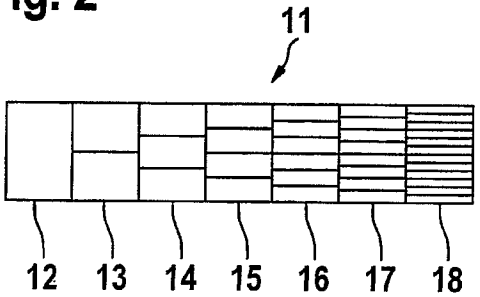
FIG. 2 shows a browning scale on the display and control device.

If the display and control device is a touch screen, the operator can touch the surface of the product to be cooked 10 at an arbitrarily place to adjust a browning of the roast. As shown in FIG. 2, a browning scale 11 appears on the display and control device with, in this example, seven browning adjustment areas 12-18. The number of these areas and the colors shown on them depend on the selected product to be cooked. Thus, the colors appearing when a roast is cooked will be different than when a bread is cooked. Even when bread is baked, the color scales can differ depending on the dough used, since a light color scale should be used with white bread and a darker color scale should be used with rye bread due to the use of different types of flour. When chicken is cooked, a light color scale is used, for example, when the chicken is cooked naturally, while a darker color scale is used when the chicken is cooked with a large number of spices.

Figure 3:
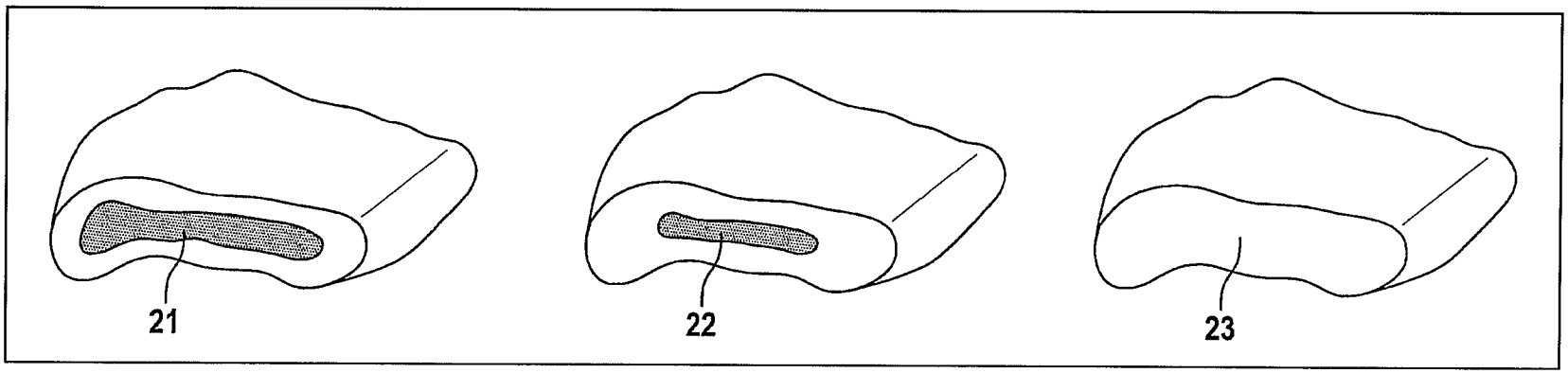
FIG. 3 shows full cooking adjustment areas on the display and control device.

As soon as an operator has adjusted the external degree of cooking of the product 1, by touching one of the browning adjustment areas 12-18, the operator can adjust an internal degree of cooking by touching the interior of the product to be cooked 10 in the illustration shown in FIG. 1. This is to specify the extent to which the product 1 should be fully cooked at the end of the cooking procedure. For this purpose, as shown in FIG. 3, the product 1 to be cooked is shown with different interiors 20. On the left side in FIG. 3, the full cooking adjustment area 21 indicates this should be a roast joint which in Germany is usually classified as "pink". In contrast, the middle in FIG. 3 is selected for a "medium" cooking of the product 1 as visually apparent by the size of its full cooking adjustment area 22. The right side in FIG. 3 is selected for "full" cooking as indicated by its small size of or lack of the full cooking adjustment area 23. The number of full cooking adjustment areas as well as the sizes, form and color of the areas naturally depend on the product to be cooked in each case. They can even differ depending on the installation site and/or the operating language of the cooking appliance.

Figure 4:
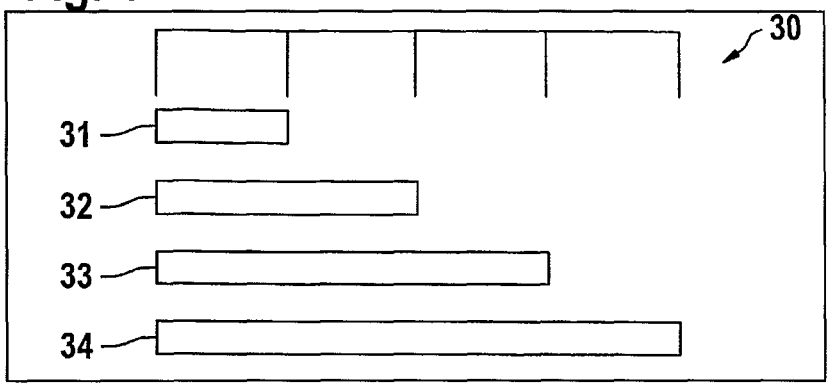
FIG. 4 shows a size scale relating to the product to be cooked on the display and control device.
Figure 5:
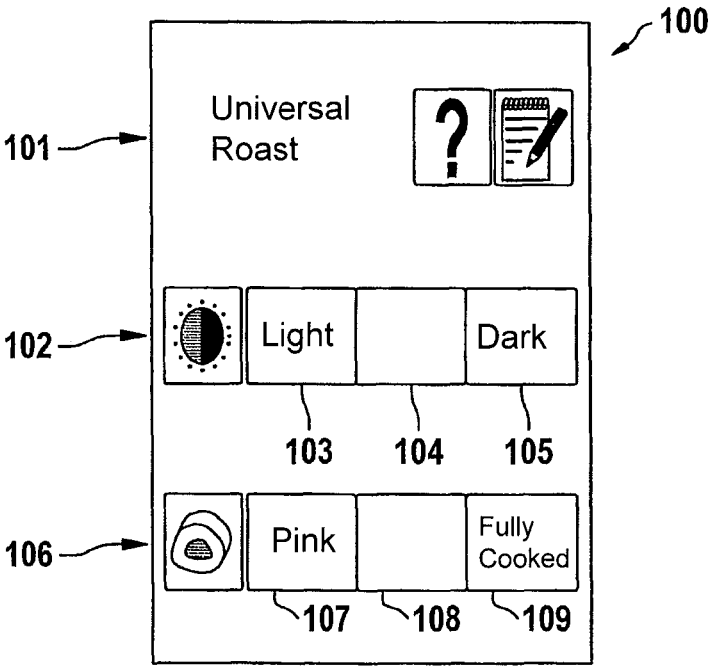
Fig. 5 PRIOR ART
FIG. 5 shows a known display and control device at a menu level.
Figure 6:
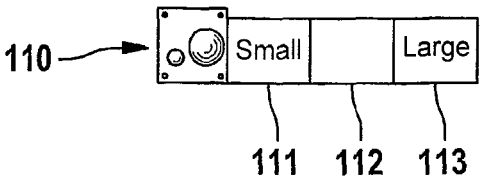
Fig. 6 PRIOR ART
FIG. 6 shows the display and control device shown in FIG. 5 in another menu level.

An operator can also enter the size of the product to be cooked 1, either prior to starting a cooking program or at the end of the program. This is not only relevant for dough products which rise during a cooking procedure, but also with other foods like pieces of meat. It is undesirable that pieces of meat of different origin with approximately the same size at the beginning of the cooking process might not be the same size at the end of the cooking process. In order to enable standard sizes, an operator can select a desired final size, defining the product's final size at the end of a cooking program. They can be by means of a size scale relating to the product to be cooked shown in FIG. 4. In this example, four product size adjustment areas 31-34 are shown. The number and the size of the adjustment areas 31-34 can depend on the type of product 1. They can also be influenced by the external and internal degree of cooking (as selected as is described with reference to FIGS. 2-3), the installation site and/or the operating language of the cooking appliance.

As soon as the adjustable parameters relating to the product to be cooked—degree of browning, interior degree of cooking and size—are selected, the desired sizes of these parameters can be displayed on the display and control device. Also, the actual parameters, relating to the product to be cooked during a cooking procedure, can be displayed. For this purpose, corresponding sensors can be used. Thus, an operator can determine by observing the display and control device the extent of progress of the adjusted cooking process. This helps avoid the need for a cooking appliance to have a transparent area to a cooking chamber, such as a glass area on cooking chamber door, which can reduce cost.

By the recording of an actual parameter relating to the product to be cooked by means of a sensor, it is also possible to estimate a residual cooking time. This can be done by comparing the recorded actual parameter with a desired end parameter relating to the product to be cooked. The residual cooking time can be displayed on the display and control device, for example in the form of an advancing bar.

Adjusted parameters relating to the product to be cooked can be stored for example in an image gallery. This can accelerate subsequent adjustment procedures of cooking programs.

In an electronic menu, the adjustable parameters relating to the product to be cooked for each product in a restaurant can be displayed in a visualized manner. This enables each visitor of the restaurant to individually select his/her desired degree of cooking at his/her table by using the menu. Thus, the menu represents a second display and control device which can transfer the customer's selected desires in a wireless manner to the cooking appliance. This enables the number of service staff in a restaurant to be reduced. At the same time, optimizing the cooking in a restaurant is possible, since the customer's desires reach the cooking appliance via electronic menus and can be processed by a control or regulating device of the cooking appliance, wherein the sequence of processing can occur according to the sequence of the selection of a cooking program and in an energy-efficient manner.

In this example, at least one of a plurality of parameters can be adjusted by means of at least one display and control device. This method can be implemented by a cooking appliance with at least one heating device, a cooking chamber, a display and control device and a control or regulating device.

Through this method, the operation of a cooking appliance can be made possible for untrained personnel by the method disclosed herein, without leading to reduced quality. It further helps avoid using text inputs when adjusting a cooking program. It illustrates even the desired cooking results in as realistic a manner as possible. The same applies to the adjustment of a cleaning program for which it should be possible to show desired cleaning results in as realistic a manner as possible.

The adjustable values of the parameter and the adjusted value can be at least temporarily displayed in a visualized manner on the display and control device. During the sequence of the operating program, the change in the parameter is displayed visually at least temporarily, either continuously or in stages.

Each adjusted parameter can be stored in the form of its visual representation, such as in an image gallery. Or it can be printed, such as in a recipe book, a hygiene report or a menu. It can be transmitted, such as in a wireless manner, with information regarding the selected operating program.

The visualization of a plurality of sizes of the product to be cooked can occur in order to adjust a second parameter relating to the product by means of the display of a plurality of size adjustment areas relating to the product to be cooked on a size scale relating to the product to be cooked. The number and/or dimension of the size adjustment areas relating to the product to be cooked can be determined depending on the selected type of product to be cooked, the selected part, the installation site of the cooking appliance, the operating language of the cooking appliance and/or at least one degree of cooking. The degree of cooking can be selected as the first parameter relating to the product to be cooked.

A cleaning program can be selected as the operating program. At least one cleaning parameter is selected as a second parameter from a plurality of cleaning parameters. At least one cleaning parameter can relate to a degree of soiling, degree of calcification and/or degree of corrosion. A characteristic first cleaning parameter and/or a characteristic second cleaning parameter for a degree of cleaning can be adjusted.

The first cleaning parameter can be determined by the quantity of dirt, lime scale and/or corrosion, the chemical composition of the dirt, the lime scale and/or corrosion, and/or the type of impact of the dirt, lime scale and/or corrosion on a surface to be cleaned, in particular determined by the temperature and the duration of the impact. The second cleaning parameter can be determined by the quantity of cleaning agents, the chemical composition of the cleaning agent and the type of impact of the cleaning agent, in particular determined by the temperature and the duration of the impact.

The inner chamber of the cooking appliance to be cleaned can be selected from a plurality of visualized inner chambers, comprising a cooking chamber, a fan chamber, a kettle of a steam generator, a quenching box, a condenser and/or a cleaning agent receptacle.

A cooking appliance might have at least one heating device, at least one cleaning device, an inner chamber, a display and control device and a control or regulation device which is arranged for implementing a method as disclosed herein.

The display and control device for displaying and/or adjusting each parameter can comprise a touch screen, a mouse and/or a joystick.

The first display and control device can be firmly connectable to the cooking appliance. The second display and control device can be conducted in a separate manner from the cooking appliance. The second display and control device can comprise an electronic menu.

The first and/or the second display and control device can be connectable, such as by means of the control or regulating device, with at least one sensing device for sensing at least one first parameter relating to the product to be cooked, at least one second sensing device for sensing at least one cleaning program and/or an external storage device and/or an external database.

This is because it is possible to dispense with the use of written information or text descriptions of a parameter to adjust said parameter. And that it is even possible to dispense with symbols for the intended description of adjustable values for the parameter which can only be reliably understood by trained operators. Both the parameter, the adjustable parameters and the parameter which has in reality been adjusted can all be displayed in a purely visualized manner, as well as in a manner which is as realistic as possible. The visualized displays can occur simultaneously, subsequently or partially overlapping.

Thus, for example, a degree of browning, which can be an external degree of cooking, can be adjusted by means of browning stages which are represented in color. The number of browning stages and their color can depend on the product to be cooked for which the degree of browning is to be adjusted. The colors can be shown in as realistic a manner for food as possible, so that an operator without any prior knowledge can adjust the degree of browning.

For adjusting an internal degree of cooking, such as the degree to which a piece of meat is to be fully cooked, the piece of meat can be shown in a partial cross-section. This is so that the interior of the product to be cooked can be seen. By the color and size of the interior of the product to be cooked, the internal degree of cooking is displayed in a visualized manner for the adjustment. The number of full cooking adjustment options as well as the size and color of the interior area of a product to be cooked, which represents the internal degree of cooking, depends on the product to be cooked in each case.

An operator can easily adjust a size of the product to be cooked, such as a desired size of a fully cooked croissant, thus to adjust the degree of cooking of the croissant, i.e. how airy or firm the croissant should be. For this purpose, a scale is shown which displays the desired dimensions of the fully cooked croissant in a realistic manner. The number of divisions on the scale as well as the size of the desired dimension depend hereby in turn on the product to be cooked.

The adjustable parameters of a cleaning program can be displayed in a visualized manner by displaying a plurality of photos of a cooking chamber taken earlier, on which different degrees of cleaning are represented in each case. This provides a realistic representation which simplifies the selection. Thus, an operator can decide whether only a removal of particles which have been collected on the base of the cooking chamber is necessary, or whether a maximum cleaning procedure resulting in shining metal surfaces is desired.

This written description uses examples to disclose the invention, including the best mode, and also to enable any person skilled in the art to make and use the invention. As shown herein, the approaches disclosed herein may be implemented in data processor environments which execute instructions to perform operations disclosed herein. The patentable scope of the invention is defined by the claims, and may include other examples that occur to those of ordinary skill in the art. Such other examples are intended to be within the scope of the claims if they have elements that do not differ from the literal language of the claims, or if they include equivalent elements with insubstantial differences from the literal language of the claims.

The invention claimed is:

1. A method for adjusting a parameter of a cooking process to be executed in a cooking appliance, said parameter relating to a degree of cooking to which food should be cooked in the cooking appliance and having a range of values, the method for adjusting a degree of internal cooking comprising:

inputting a selection of a type of food to be cooked in the cooking appliance;

displaying a set of pictorial depictions on a display, each of the pictorial depictions representing one of the values in the range, being based on the type of food selected and appearing realistically as a piece of food, with each of the pictorial depictions including an internal section and an external section, the internal sections differing with respect to full cooking adjustment areas which are representative of degree of cooking;

inputting a manual selection from among the pictorial depictions; and executing the cooking process in accordance with the value represented by the manually selected pictorial depiction.

2. The method of claim 1 wherein the pictorial depictions differ in color to represent the different values of degree of internal cooking.

3. The method of claim 1 wherein the pictorial depictions are realistic depictions of the color of the food for representative degrees of internal cooking.

4. The method of claim 1 wherein the parameter also relates to one of the size, thawing or condition of the food.

5. The method of claim 1 wherein the number of pictorial depictions displayed is based on the type of food selected.

6. The method of claim 1 wherein the inputting of the selection of the type of food includes first inputting a selected type of animal, then displaying pictorial depictions of parts of the selected type of animal, and then inputting a manual selection from among the pictorial depictions of the parts of the selected animal.

7. The method of claim 1 wherein the cooking appliance performing the cooking process is an oven in a restaurant, and the inputting of the selection entails inputting, directly from a customer visiting the restaurant, the customer's selection.

8. A method for adjusting a parameter of a cooking process to be executed in a cooking appliance, said parameter relating to a degree of cooking to which food should be cooked in the cooking appliance and having a range of values, the method for adjusting a degree of external cooking comprising:

inputting a selection of a type of food to be cooked in the cooking appliance;

displaying a set of pictorial depictions on a display, each of the pictorial depictions representing one of the values in the range and being based on the type of food selected, the pictorial depictions differing in color to represent the different values of degree of external cooking and being realistic depictions of the color of the food for representative degrees of external cooking;

inputting a manual selection from among the pictorial depictions; and executing the cooking process in accordance with the value represented by the manually selected pictorial depiction.

9. The method of claim 8 wherein the pictorial depictions appear realistically as a piece of food, with each depiction including an internal section and an external section, the external sections differing with respect to the color.

10. The method of claim 8 wherein the parameter also relates to one of the size, thawing or condition of the food.

11. The method of claim 8 wherein the number of pictorial depictions displayed is based on the type of food selected.

12. The method of claim 8 wherein the inputting of the selection of the type of food includes first inputting a selected type of animal, then displaying pictorial depictions of parts of the selected type of animal, and then inputting a manual selection from among the pictorial depictions of the parts of the selected animal.

13. The method of claim 8 wherein the cooking appliance performing the process is an oven in a restaurant, and the inputting of the selection entails inputting, directly from a customer visiting the restaurant, the customer's selection.

14. A method for adjusting a parameter of a cooking process to be executed in a cooking appliance, said parameter relating to a degree of cooking to which food should be cooked in the cooking appliance and having a range of values, the method for adjusting a degree of internal cooking as well as a degree of external cooking comprising:

inputting a selection of a type of food to be cooked in the cooking appliance;

displaying a set of pictorial depictions on a display, each of the pictorial depictions representing one of the values in the range, being based on the type of food selected and appearing realistically as a piece of food, with each of the pictorial depictions including an internal section and an external section, the internal sections differing with respect to full cooking adjustment areas which are representative of degree of cooking, the pictorial depictions differing in color to represent the different values of degree of external cooking and being realistic depictions of the color of the food for representative degrees of external cooking;

inputting a manual selection from among the pictorial depictions; and executing the cooking process in accordance with the value represented by the manually selected pictorial depiction.

15. The method of claim 14 wherein the parameter also relates to one of the size, thawing or condition of the food.

16. The method of claim 14 wherein the number of pictorial depictions displayed is based on the type of food selected.

17. The method of claim 14 wherein the inputting of the selection of the type of food includes first inputting a selected type of animal, then displaying pictorial depictions of parts of the selected type of animal, and then inputting a manual selection from among the pictorial depictions of the parts of the selected animal.

18. The method of claim 14 wherein the appliance performing the process is an oven in a restaurant, and the inputting of the selection entails inputting, directly from a customer visiting the restaurant, the customer's selection.

* * * * *